US007104310B2

(12) United States Patent
Hunter

(10) Patent No.: US 7,104,310 B2
(45) Date of Patent: Sep. 12, 2006

(54) MOLD MAKING MACHINE WITH SEPARATED SAFETY WORK ZONES

(75) Inventor: William A. Hunter, Naples, FL (US)

(73) Assignee: Hunter Automated Machinery Corporation, Schaumburg, IL (US)

( * ) Notice: Subject to any disclaimer, the term of this patent is extended or adjusted under 35 U.S.C. 154(b) by 0 days.

(21) Appl. No.: 11/023,312

(22) Filed: Dec. 27, 2004

(65) Prior Publication Data

US 2006/0137850 A1 Jun. 29, 2006

(51) Int. Cl.
*B22D 46/00* (2006.01)

(52) U.S. Cl. ..... 164/456; 164/152; 164/153; 164/154.1; 164/183; 164/169; 164/224

(58) Field of Classification Search ..... 164/456, 164/152, 153, 154.1, 183, 169, 224
See application file for complete search history.

(56) References Cited

U.S. PATENT DOCUMENTS

| | | | | |
|---|---|---|---|---|
| 3,406,738 | A | 10/1968 | Hunter | |
| 3,506,058 | A | 4/1970 | Hunter | |
| 3,520,348 | A | 7/1970 | Hunter | |
| 4,657,064 | A | 4/1987 | Hunter | |
| 4,699,199 | A | 10/1987 | Hunter | |
| 4,738,299 | A | 4/1988 | Hunter | |
| 4,840,218 | A | 6/1989 | Hunter | |
| 4,848,440 | A | 7/1989 | Hunter | |
| 4,890,664 | A | 1/1990 | Hunter | |
| 5,022,512 | A | 6/1991 | Hunter | |
| 5,853,042 | A | 12/1998 | Hunter | |
| 5,901,774 | A | 5/1999 | Hunter et al. | |
| 5,927,374 | A | 7/1999 | Hunter et al. | |
| 5,971,059 | A | 10/1999 | Hunter et al. | |
| 5,975,872 | A * | 11/1999 | Raines et al. | 425/136 |
| 6,137,408 | A * | 10/2000 | Okada | 340/556 |
| 6,145,577 | A | 11/2000 | Hunter et al. | |
| 6,571,860 | B1 | 6/2003 | Hunter et al. | |
| 6,622,772 | B1 | 9/2003 | Hunter | |
| 6,779,586 | B1 | 8/2004 | Hunter et al. | |
| 6,817,403 | B1 | 11/2004 | Hunter | |
| 6,868,894 | B1 * | 3/2005 | Knudsen | 164/340 |

OTHER PUBLICATIONS

Hunter Automated Machinery Corporation; Internet; G & H Series Molding Machines; www.hunterauto.com; Date Last Visited Nov. 5, 2004; four pages.
Scientific Technologies Inc.; Internet; Safety Light Curtains; www.sti.com; Date Last Visited Nov. 3, 2004; two pages.
Scientific Technologies Inc.; Internet; Light Curtains Selection Guide; www.sti.com; Date Last Visited Nov. 3, 2004; three pages.

* cited by examiner

*Primary Examiner*—Kevin Kerns
*Assistant Examiner*—I.-H. Lin
(74) *Attorney, Agent, or Firm*—Leydig, Voit & Mayer, Ltd

(57) ABSTRACT

An automatic molding machine has different operational molding stations in which at least two different safety zones are provided for the different molding stations. Such an automated machine includes a mold flask assembly including a drag flask, a cope flask and a pattern plate. An electronic controller controls the molding machine differently when different safety zones are breached.

11 Claims, 2 Drawing Sheets

MOLD MAKING MACHINE WITH SEPARATED SAFETY WORK ZONES

FIELD OF THE INVENTION

The present invention generally relates to automated matchplate molding machines for forming sand molds for use in foundries, and more particularly relates to apparatus in such mold making equipment for halting the molding machine when a safety zone is breach.

BACKGROUND OF THE INVENTION

Foundries use automated matchplate molding machines for forming sand molds. Formed sand molds are subsequently filled with molten metal material, cooled, and then broken apart to release metal castings. There are several prior art systems for this purpose including several prior art systems assigned to the present Assignee, Hunter Automated Machinery Corporation, including U.S. Pat. No. 3,406,738 to Hunter; U.S. Pat. No. 3,506,058 to Hunter; U.S. Pat. No. 4,890,664 to Hunter; U.S. Pat. No. 4,699,199 to Hunter; U.S. Pat. No. 4,840,218 to Hunter; and U.S. Pat. No. 6,622,722 to Hunter. The entire disclosures of these patent references are hereby incorporated by reference as the present invention may be incorporated or used in these types of molding systems. Additional reference can be had to these patent references for additional details of the state of the art and to see potential applicability of the present invention.

In automated matchplate molding machines of this type such as the HMP type molding machine that is manufactured and commercially available from Hunter Automated Machinery Corporation, the present assignee of the instant application, a pair of safety curtains is provided for safety reasons. The safety curtains are a type of sensor that define a safety zone that encompasses the outer sides of the molding machine in close proximity to the working interior of the machine. When this safety zone is breached, the entire molding machine is halted to a stop to shut down all operations and thereby prevent a worker who is breached the safety zone from being struck by the components or caught in the components of the molding machine.

While the foregoing inventions have set forth significant advances and advanced the state-of-art, there is still further room for improvement in automated molding machinery which is the subject of the present invention.

BRIEF SUMMARY OF THE INVENTION

The present invention is directed toward an automatic molding machine having different operational stations in which at least two different safety zones are provided for different molding stations. Such an automated molding machine includes a mold flask assembly including a drag flask, a cope flask and a pattern plate for creating sand molds. The molding machine includes a first molding stations whereat at least one operation of a sand mold forming cycle is conducted with at least part of the mold flask assembly and a second molding station whereat at least one operation of a sand mold forming cycle is also conducted with at least part of the mold flask assembly. A first safety zone is generated by at least one first safety sensor and a second safety zone is generated by at least one second safety sensor. A controller (e.g. a microprocessor, a programmable logic device, or other such suitable controller) is responsive to the first and second safety sensors and controls operations at the first and second molding stations. The controller halts at least one operation of the sand mold forming cycle at the first molding station when the first safety zone is breached and halting at least one operation of the sand mold forming cycle at the second molding station when the second safety zone is breached. By providing two different safety zones, the controller is able to control the molding machine differently when different safety zones are breached. This can provide for greater efficiency and a quicker molding cycle for example when optional sand core setting equipment is used, when the mold cavity is inspected, or when other interference operations (whether it be automatic or manual) are conducted within the respective molding stations of the automated molding machine.

Other aspects, objectives and advantages of the invention will become more apparent from the following detailed description when taken in conjunction with the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
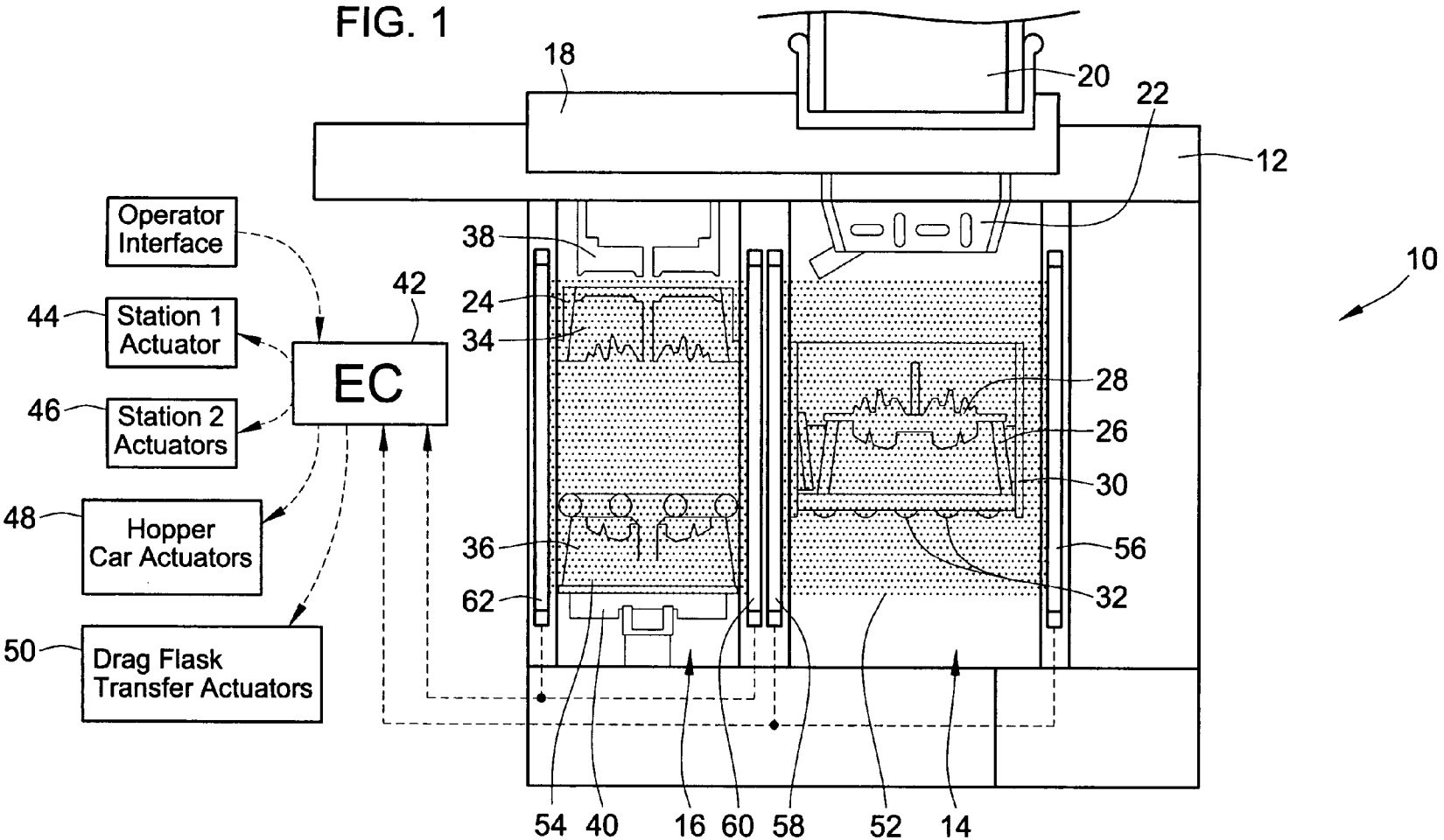
FIGS. 1 and 2 are partly schematic side elevational representations of a molding machine illustrating different opposing sides of an embodiment of the present invention and an example of an environment in which the present invention may be implemented.

Turning to FIG. 1, an example of an embodiment of an automatic matchplate molding machine 10 is illustrated in partly schematic form. With the exception of the inventive improvements as discussed herein, the machine illustrated may comprise one of the HMP type molding machines that are manufactured and commercially available from Hunter Automated Machinery Corporation, the present assignee of the instant patent application. Machines of these types are well known to those of ordinary skill in the art and are widely used throughout the foundry industry. In view of the fact that many of the details of different types of HMP machines or other such machines are known and also shown generally in the aforementioned patents which have been incorporated by reference, discussion of the general operation of the machine will thus be limited and particular focus will be given to the particular inventive improvements of the machine 10 which are discussed and claimed herein.

As shown in FIG. 1, the molding machine 10 includes a support frame 12. Different sections of the support frame 12 provide for different work stations, which may include for example a drag flask filling station 14 and a mold squeeze and release station 16. In the illustrated embodiment, the molding machine 10 includes a movable hopper car 18 which includes a sand hopper 20 that is filled with sand. The sand hopper 20 has an openable and closable discharge port 22 which is adapted to align with and discharge sand separately into a cope flask 24 and a drag flask 26. The hopper car 18 linearly reciprocates horizontally along a top portion of the support frame 12. The hopper car 18 automatically shifts back and forth between the mold squeeze and release station 16 and the drag flask filling station 14. This alternately and successively positions the sand hopper 20 at the mold squeeze and release station 16 to fill the cope flask 24, and the drag flask filling station 14 to fill the drag flask 26. The cope flask 24 is always situated at the mold squeeze and release station 16 during all successive molding operations of the machine 10, while the drag flask 26 (and pattern plate 28 which is typically secured thereto) is carted back and forth between the two stations 14, 16. To facilitate the horizontal cycling back and forth between the two stations, rollers 30 are provided upon which the drag flask 26 is adapted to ride and roll between the two stations.

At the drag flask filling station 14, the drag flask is received in a rollover cradle 32 that flips the drag flask upside down such that the open end of the drag flask 26 faces the discharge port 22 of the sand hopper 20 allowing the drag flask 26 to be filled with sand. After the drag flask is filled with sand it can then be turned over again by the rollover cradle 30 to an upright position and then shifted to the mold squeeze and release station 16, where it is assembled with the cope flask that is then filled with sand, squeezed and then disassembled to release the formed cope and drag molds 34, 36. Formed molds 34, 36 are then output to downstream mold handling equipment for receipt of molten metal to produce metal castings.

The mold squeeze and release station 16 includes several relatively conventional components including a squeeze head 38 that is adapted to be received in an open end of the cope flask and a platen table 42 which is adapted to be received in the open end of a drag flask 44. As shown, the squeeze head 38 and platen table 42 are arranged in opposition relative to each other with sufficient space provided therebetween to receive the mold flask assembly for the formation of sand molds. Preferably the plunging axis is vertically aligned as shown, with the platen table 42 located vertically underneath the squeeze head 38. The platen table 42 is actuated up and down to facilitate squeezing of sand and cope and drag mold release and assembly operations.

As is schematically indicated in FIG. 1, an electronic controller 42 (e.g. such as a microprocessor, digital or analog processor, a programmable logic device, or other such controller) is provided to control actuation of the various components of the machine 10. The electronic controller 42 receives various inputs both from the machine and also manual inputs from a machine operator/worker to control the operation of the machine. The electronic controller 42 is schematically indicated in FIG. 1 to control various schematically illustrated actuators. This includes control over various "station one" actuators 44 (e.g. such as the actuators that drive and rotate the rollover cradle, and other such components); and also various "station two" actuators 46 (such as the platen hydraulic cylinder, cope mold lift cylinders, platen engagement locking pins, and other such component actuators). The electronic controller 42 also issues commands to control other such actuators which may be shared by the two stations or disposed at either or both stations of the machine depending upon the operational state of the machine, such as for example hopper car actuators 48 (e.g. those actuators which drive the hopper car back and forth and those which control the sand discharge); and drag flask transfer actuators 50 (e.g. those that automatically shift the drag flask back and forth between the two stations 14, 16). These two last categories of actuators 48, 50 may be considered to be both or either "station one" and/or "station two" actuators. The various actuators may include hydraulic actuators, pneumatic actuators and electric actuators as may be common in such molding machines. The electronic controller 42 will issue output commands that work through appropriate solenoid valves, hydraulic pumps, and/or fluid control devices to facilitate such actuation in a manner that will be readily understood by one skilled in the art.

Turning in greater detail to the improvements of the subject invention, two different safety zones 52, 54 are provided for the respective two different molding stations 14, 16. The safety zones 52, 54 are schematically illustrated via dotted lines in FIG. 1 extending between two different safety sensors, which may take the form of safety light curtains 56, 58, 60, 62. The safety light curtains provide optical guarding in that they provide an invisible barrier. Once the safety zone is broken or penetrated such as by an arm, a leg or any such object, the safety light curtains generate an output signal, that is typically used for generating a safety mode for the machine. One such manufacturer of such safety curtains is Scientific Technologies, Inc. located at 6550 Dumbarton Circle, Fremont, Calif. 94555. Although one type of safety sensor is illustrated, it will be appreciated that other types of safety sensors may be provided such as machine vision, other optical sensors, and/or floor mats which are weight sensitive, but also provide a safety zone. Certain broader claims appended hereto are meant to include other sensor possibilities.

As shown in FIG. 1, a first pair of the safety light curtains 56, 58 are mounted in vertical orientation and spaced apart from one another in parallel relation to the support frame 12. The safety light curtains 56, 58 face each other and have optical light emitters and sensors along their vertical length to create a vertical span to form the first safety zone 52 as is schematically indicated. The first safety zone 52 substantially covers and is complementary to that of the first molding station such that normal access to the first molding station 14 via an arm, an object, leg or other body part would have to penetrate and breach the first safety zone 52. In the event of such breach, that first pair of safety-like curtains 56, 58 generate an output indicating the breach to the electronic controller 42.

The second pair of safety light curtains 60, 62 are much like the first set of safety-like curtains 56, 58, but in contrast are located at the second molding station 16. These curtains 60, 62 are similarly mounted in a vertical orientation to the frame 12 and are spaced apart in parallel relation to form the second safety zone 54 as is schematically indicated. The second safety zone 54 covers a span substantially similar to the span of the second molding station 16 and is complimentary to that of the second molding station 16 such that when an object or someone reaches into the second molding station, the second safety zone 54 is penetrated and breached, which causes the curtains 60, 62 to generate an output signal to the electronic controller 42 indicating such breach.

Unlike the prior art, different safety zones are provided for different molding stations of the molding machine 10. It is an advantage of this configuration that the machine is smarter in that it knows where a safety breach is occurring and can shut down different operations as appropriate. In particular, the controller 42 can control the molding machine differently when different safety zones are breached. The electronic controller 42 does this by halting different selected ones of the actuators 44, 46, 48, 50 when the first safety zone 52 is breached and a different selected ones of the actuators 44, 46, 48, 50 when the other safety zone 54 is breached. This can be done in a number of ways and with different orientations of different safety zones other than that as illustrated.

With the disclosed embodiment, one example of an operable configuration will be discussed below, which provides for some particular advantages with this type of a molding machine 10. According to one operational example, when the first safety zone 52 is breached, the "station one" actuators 44 (and potentially the hopper car and transfer actuators 48, 50 also) are halted to a stop. This prevents possible interference of the breach object with moving components at the first molding station 14. However, at least one operation at the second mold forming station 16 may continue if not completed. Similarly, when the second safety zone 54 is breached, the "station two" actuators 46 (and potentially the hopper car and transfer actuators 48, 50 also) are halted to a stop to thereby prevent interference with moving components at the second station 16. However, the "station one" actuators may continue to operate as long as the first safety zone 52 is not breached. Thus, molding operations can continue at the first mold forming station.

One potential advantage of this type of an approach is when core setting equipment is used or when it is desired to inspect core setting and/or to inspect a newly formed mold cavity which would occur at the mold squeeze and release station 16. At this station, breaching the second safety zone 54 may be necessary in order to accomplish these tasks. Rather than shutting down the entire machine, however, operations can continue at the drag flask fill station 14. In this regard, the rollover cradle 30 may continue to operate and rotate the drag flask upside down and right side up and appropriate actuators 48 associated with the hopper car 18 can continue to operate in order to facilitate discharge of sand into the drag flask 26 for the purpose of filling the drag flask 26 with sand. By preventing a shutdown of the first station 44 in this manner, the efficiency and speed of the machine can be increased by having certain molding operations continue while others are temporarily halted in the event of a breach of one of the safety zones. Likewise, it may be desirable to continue operations at the second squeeze and release station 16 when the first safety zone 52 is breached thereby halting or shutting down operations at the drag flask fill station 14. For example, a worker may need to tend to the pattern plate or may need to attend to something or clean something at the first drag flask fill station 14. Rather than shutting down the entire machine, operations at the second mold squeeze and release station 16 may continue which may also lead to improved speed and efficiency of the machine.

Figure 2:
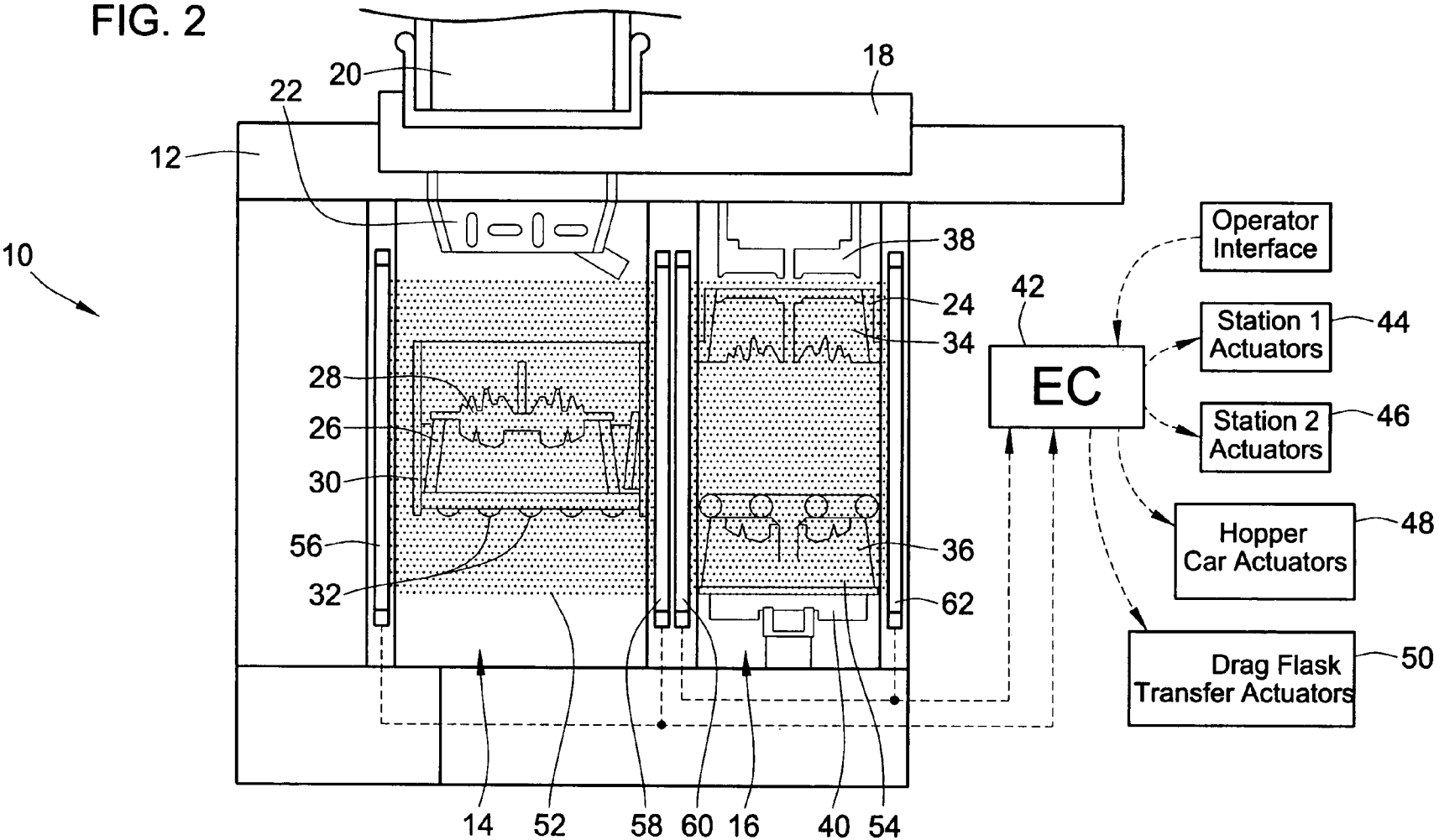

It should be noted that there are two opposing sides typically to such a molding machine such that the first safety zone 52 is provided on both sides of the machine as can be seen with additional reference to FIG. 2. Similarly, the second safety zone 54 is also provided on the other side of the machine. Additional safety light curtains 56, 58, 60, 62 are also provided in a similar manner on the second side of the machine as shown in FIG. 2 such that there are two different pairs of light curtains for each different safety zone 52, 54.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An automated molding machine, comprising:

a mold flask assembly including a drag flask, a cope flask and a pattern plate for creating sand molds;

a first molding station whereat at least one operation of a sand mold forming cycle is conducted with at least a part of the mold flask assembly;

a second molding station whereat at least one operation of a sand mold forming cycle is conducted with at least a part of the mold flask assembly;

a first safety zone generated by at least one first safety sensor;

a second safety zone generated by at least one second safety sensor; and a controller responsive to the first and second safety sensors and providing output signals for controlling operations at the first and second molding stations, the controller providing a first output signal to halt at least one operation of the sand mold forming cycle at the first molding station and providing a second output signal to control at least one operation of the second mold forming station when the first safety zone is breached, and the second safety zone is not breached, wherein the controller controls the molding machine differently when different safety zones are breached.

2. The automated molding machine of claim 1, wherein at least one operation of the second mold forming station continues until completed when the first safety zone and not the second safety zone is breached.

3. The automated molding machine of claim 1, wherein the controller provides a third output signal to halt at least one operation of the sand mold forming cycle at the second molding station when the second safety zone is breached, and wherein at least one operation of the first mold forming station if not completed continues when the second safety zone and not the first safety zone is breached.

4. The automated molding machine of claim 1, further comprising an actuator for transferring a portion of the mold flask assembly between the first and second molding stations, wherein the controller provides a fourth output signal to halt the actuator when either or both of the first and second safety zones is breached.

5. The automated molding machine of claim 3, wherein the first molding station includes a rollover cradle for receipt of the drag flask, the rollover cradle having a drag fill mode wherein the rollover cradle is rotated by a first actuator to position the drag flask for receipt of loose sand, the electronic controller providing the first control signal to deactivate the first actuator when the first safety zone is breached.

6. The automated molding machine of claim 5, wherein the second molding station includes a platen table operated by a second actuator, the platen table having a squeeze mode wherein the platen table driven by the second actuator squeezes sand contained in the mold flask assembly against a squeeze head, the electronic controller providing the third output signal to halt the second actuator when the second safety zone is breached.

7. The automated molding machine of claim 6, further comprising a hopper car carrying the squeeze head and a sand hopper having a discharge port, a third actuator reciprocating the hopper car cyclically to successively locate the discharge port alternately at the first and second molding stations for filling the drag flask and the cope flask, respectively, the electronic controller providing a fifth output signal to halt the third actuator when either or both of the first and second safety zones is breached.

8. The automated molding machine of claim 7, further comprising a fourth actuator for transferring a portion of the mold flask assembly between the first and second molding stations, wherein the controller provides a sixth output signal to halt the fourth actuator when either or both of the first and second safety zones is breached.

9. The automated molding machine of claim 1, wherein said first and second safety sensors comprises light curtains mounted to a frame of the automated molding machine, wherein cooperating pairs of light curtains provide for the first and second safety zones.

10. The automated molding machine of claim 1, wherein the first safety zone includes a first set pair of light curtains on a first side of the machine, and a second pair of light curtains on a second side of the machine, and wherein the second safety zone includes a third pair of light curtains on the first side of the machine and a fourth pair of light curtains on the second side of the machine.

11. A method for making a mold in an automated molding machine including a mold flask assembly with a drag flask, a cope flask and a pattern plate for creating sand molds, a first molding station whereat at least one operation of a sand mold forming cycle is conducted with at least a part of the mold flask assembly, and a second molding station whereat at least one operation of a sand mold forming cycle is conducted with at least a part of the mold flask assembly, the method including the steps of:

generating a first sensing signal indicating whether a safety breach has occurred in a first safety zone provided by at least one first safety sensor;

generating a second sensing signal indicating whether a safety breach has occurred in a second safety zone provided by at least one second safety sensor;

providing a first output signal to halt at least one operation of the sand mold forming cycle at the first molding station in response to the first sensing signal indicating that the first safety zone is breached; and providing a second output signal to control at least one operation of the second mold forming station in response to the second sensing signal indicating that the second safety zone is not breached.

* * * * *